US006109606A

United States Patent [19]

Johnson et al.

[11] Patent Number: 6,109,606

[45] Date of Patent: Aug. 29, 2000

[54] STACK QUALITY OF PRINTED PAPER

[75] Inventors: Steven M. Johnson, Eagle, Id.; Tadei Hernandez, Guadalajara, Mexico

[73] Assignee: Hewlett-Packard Company, Palo Alto, Calif.

[21] Appl. No.: 09/324,736

[22] Filed: Jun. 3, 1999

[51] Int. Cl.[7] ..... B65H 31/04

[52] U.S. Cl. ..... 271/213; 271/215

[58] Field of Search ..... 271/207, 209, 271/213, 214, 215

[56] References Cited

U.S. PATENT DOCUMENTS 4,229,650 10/1980 Takahashi et al. ..... 271/215 X 5,318,401 6/1994 Mandel ..... 271/214 X

*Primary Examiner*—David H. Bollinger

[57] ABSTRACT

Paper decurling is achieved at the output of a printer or other paper handling machine by discharging sequential sheets of the paper into an angled tray. Upon sensing of the paper at a predetermined height, paper curling is presumed and the tray is caused to drop. This causes the sheets to slide against an end stop and drop down with the tray. The tray then returns back upward, whereupon the sheets, which are sliding against the end stop are decurled at an end of the tray facing the discharge portion of the paper handling machine. The movement of the tray is further controlled so as to establish the stack at a uniform predetermined height at the end of each print job.

17 Claims, 9 Drawing Sheets

STACK QUALITY OF PRINTED PAPER

FIELD OF THE INVENTION

This invention relates to paper handling. More particularly, it relates to reducing the effects of paper curl in the output bin of a paper handling machine, such as a printer.

BACKGROUND OF THE INVENTION

Paper curl is a common problem in the field of printing and more particularly in the field of electrostatic printing. Often, attempts are made to determine a direction of curl of supplied paper, and the paper is loaded into the supply bins of a printer or copier in a particular direction in accordance with the direction of curl. The printing process itself imparts effects on the paper which can result in curl. Finally, the feeders of a paper handling machine, and particularly the output feeders, are designed to counteract a tendency for paper curling. Since there is a variation in the quality and initial curl of the paper, it is not always possible to discharge paper in a manner which eliminates curling. If the output of a paper handling machine is used to create a stack of paper, it is desired that the stack be in registration, meaning that the ends of the sheets align. In order to accomplish this, the sheets are caused to rest against an end stop, and this end stop defines a registration position of the sheets. This creates two problems with respect to curl: (1) if the paper is curled, the sheets tend to rest high in the bin at the end stop; (2) the movement of the sheets downwardly against the end stop itself encourages curl as a result of friction of the sheets against the end stop.

Paper stack quality is a critical parameter for high capacity output devices on laser printers and copiers. Paper curl is a significant problem when stacking paper coming out of a laser printer. Reasons for this behavior are humidity, temperature during the toner fusing process, toner distribution on the printed paper, composition and weight of the paper, printed side, ejection speed of the paper when leaving the printer, shape of the bin on which the paper is being stacked, etc. Paper curl can be positive curl, as shown in FIG. 1, and negative curl, as shown in FIG. 2. Essentially, positive and negative curl are a function of which way the paper lies; that is, negative curl becomes positive curl if the sheets are tuned over, and vice-versa.

Of the two types of curl previously mentioned, the one that can cause more problems to the device is positive curl. One of the problems that this type of curl can cause is that it can obstruct the paper path as depicted in FIG. 3. Another problem is that the trailing edge of the last stacked paper can touch the eject rollers, allowing it to be transported back to the device, as depicted in FIGS. 4*a* and 4*b*. This can cause a paper jam.

Paper curl is normally corrected using decurlers or retainers. Decurlers work by making the paper go through a series of rollers as shown in FIG. 5, instead of using a straight path. This creates a buckle in the opposite direction of the curl; that is, increasing the positive or the negative curl. Some of the disadvantages of this approach are:

Decurlers do not work well on all kinds of paper. Since the curl on the paper can be either positive or negative, and the decurlers work by increasing the positive or the negative curl (but not both), it may be increasing the curl on the paper. Decurlers can cause paper jams.

Retainers on the other hand, are long and flexible fingers mounted on a shaft right above the trailing edge of the stack, as shown in FIG. 6. When the paper leaves the eject rollers, the paper flies above the retainers and then the retainers rotate. On rotation, the retainers grab the last ejected page and push it back against the wall (registering). This also reduces the curl of the paper. One disadvantage of this approach is that it adds more components to the device.

SUMMARY OF THE INVENTION

In accordance with the present invention, paper or other sheet media discharged from paper handling equipment, such as a printer is dropped onto a slanted tray. The tray has an end stop at a lower end of the tray in the form of an end wall. The sheets come to rest on the tray against the end stop. Upon discharge of one or more sheets, the output tray moves down against the end stop. After the sheets have dropped down with the tray, the tray then moves back up. This causes the sheets to drag against the end stop during the upward movement. This in turn causes the sheets to rest in registration against the end wall and also has a tendency of curling the sheets, particularly in the case of positive curl. Since the operation occurs shortly after paper processing by the printer, the sheets have a tendency to decurl by virtue of their lying flat.

This invention involves the use of the friction between the paper stack and the end wall in order to fix the positive curl of the trailing edge of the paper stack, instead of using decurlers or retainers on the eject rollers. A variable height output bin is combined with optoelectric sensors and a microcontroller for detecting the presence of paper on the bin as well as a bin full condition. Normally, all of these components are already implemented in a paper stacking device.

At a predetermined event, a decurling process is initiated. In a preferred embodiment, the predetermined event is an amount of pages collected on the stack. In that preferred embodiment, after a certain amount of pages are collected on the stack, an optoelectric sensor is activated, indicating a bin full condition. In response to the sensed bin full condition, the output bin starts moving down. Once the bin full sensor and a paper present sensor are deactivated, the direction of the output bin is changed. At that time, the friction of the paper rubbing against the wall of the device will cause the positive curl to decrease. At this point, the process could continue in order to always position the bin at the same height. By way of example, when the bin full sensor is reactivated, the bin changes direction again and moves down for a small amount of time so that the bin full sensor is deactivated but the paper present sensor remains active. This has the advantage of always positioning the bin at the same height.

The main advantages of this approach are:

Mechanically the device is simplified because it relies on a simpler paper path, and does not add additional components to a fully functional paper stacker.

The process is easily controlled through firmware.

The decurling operation works well for different types of paper.

BRIEF DESCRIPTION OF THE DRAWINGS

FIG. 4*a* shows the alignment of the curled paper with the eject rollers and 4*b* shows the eject rollers attempting the transport the sheet back into the printer.

DETAILED DESCRIPTION OF THE PREFERRED EMBODIMENTS

Figure 1:
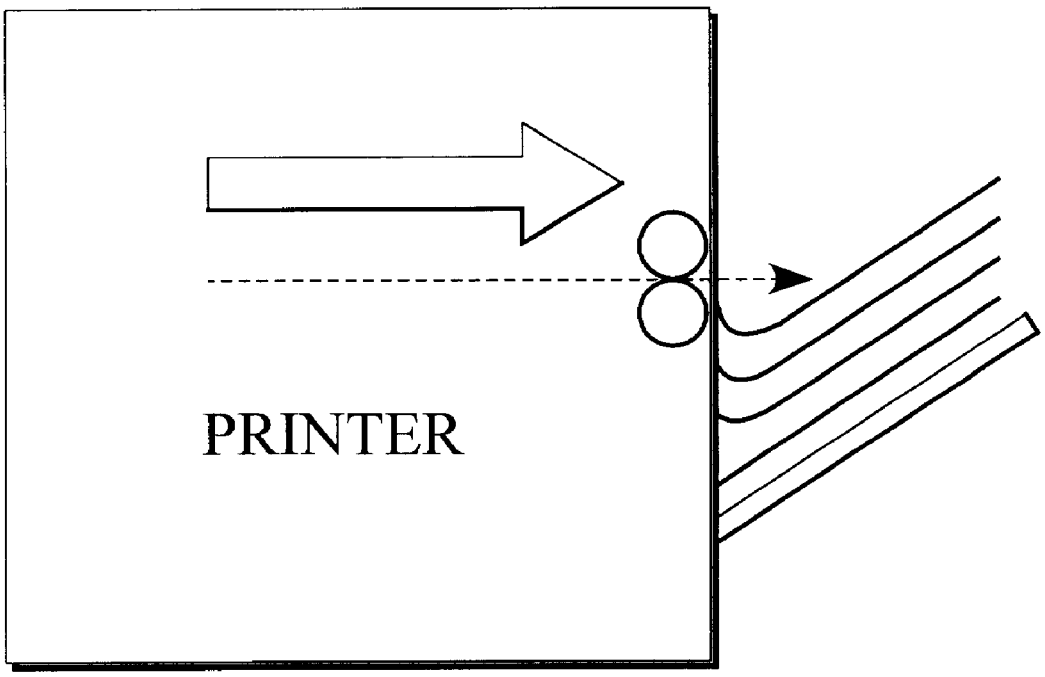
Fig. 1 (Prior Art)
FIG. 1 (prior art) shows the effect of positive paper curl at the output of a printer.
Figure 2:
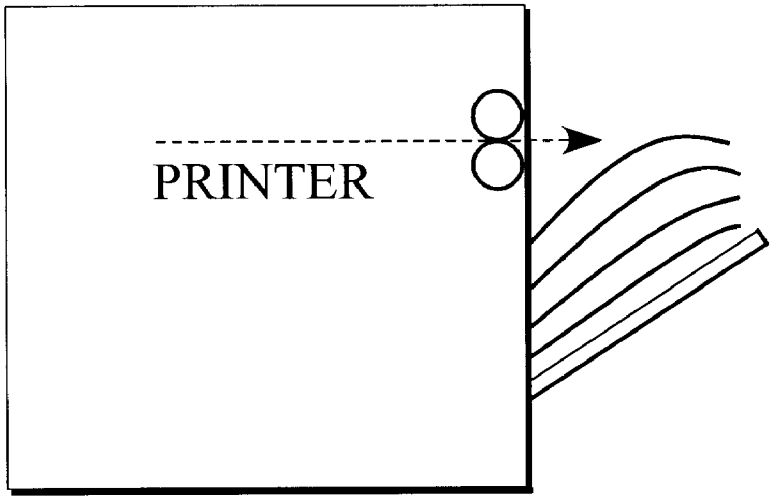
Fig. 2 (Prior Art)
FIG. 2 (prior art) shows the effect of negative paper curl at a paper output.
Figure 3:
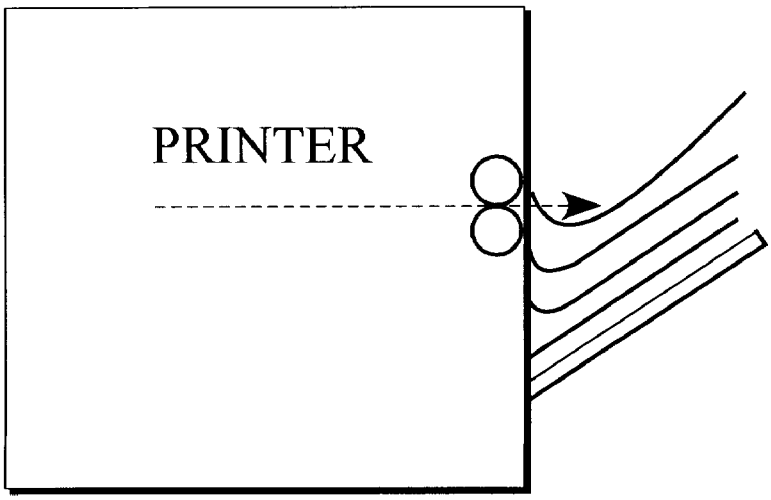
Fig. 3 (Prior Art)
FIG. 3 (prior art) shows the effect of positive paper curl interfering with the output paper path of a printer.
Figure 4A:
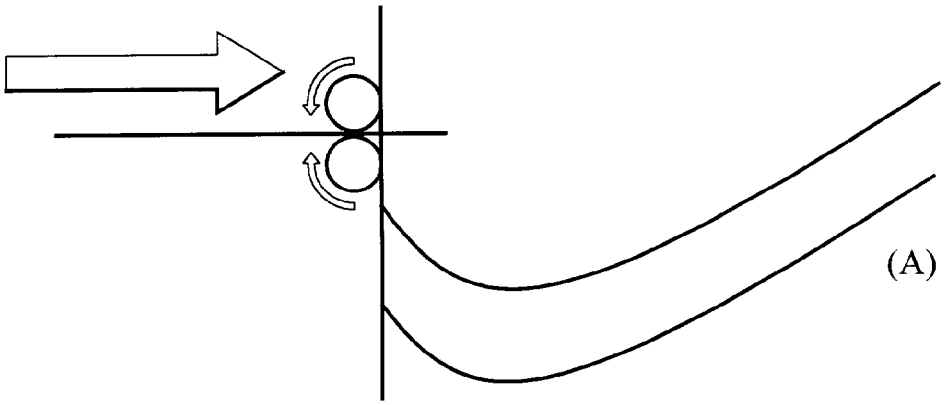
Fig. 4A (Prior Art)
FIGS. 4*a* and 4*b* (both prior art) show the effects of curled paper engaging eject rollers after the sheet has been discharged.
Figure 4B:
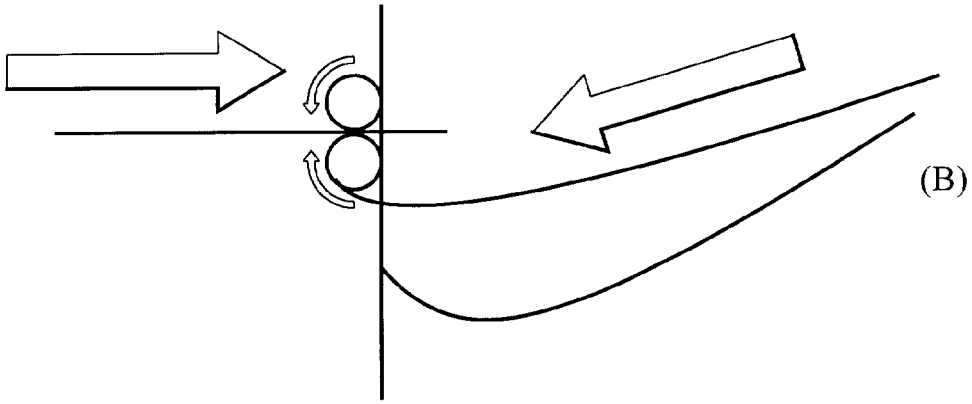
Fig. 4B (Prior Art)
Figure 5:
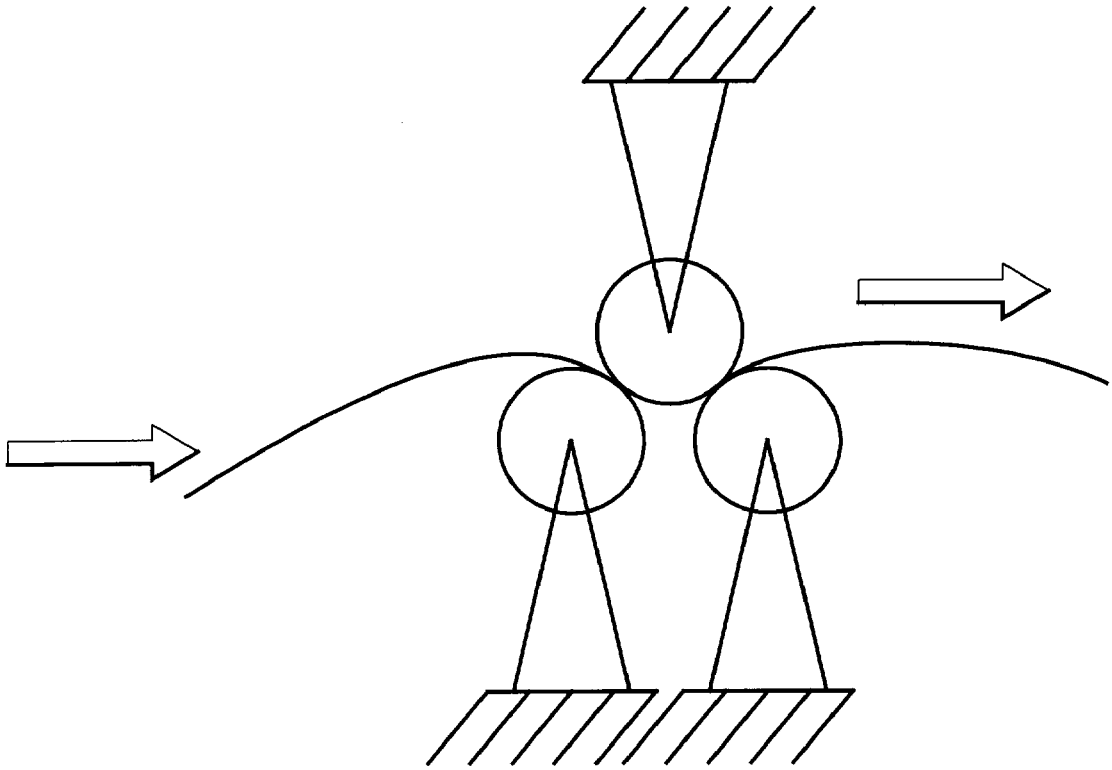
Fig. 5 (Prior Art)
FIG. 5 (prior art) shows decurlers used to correct paper curl.
Figure 6:
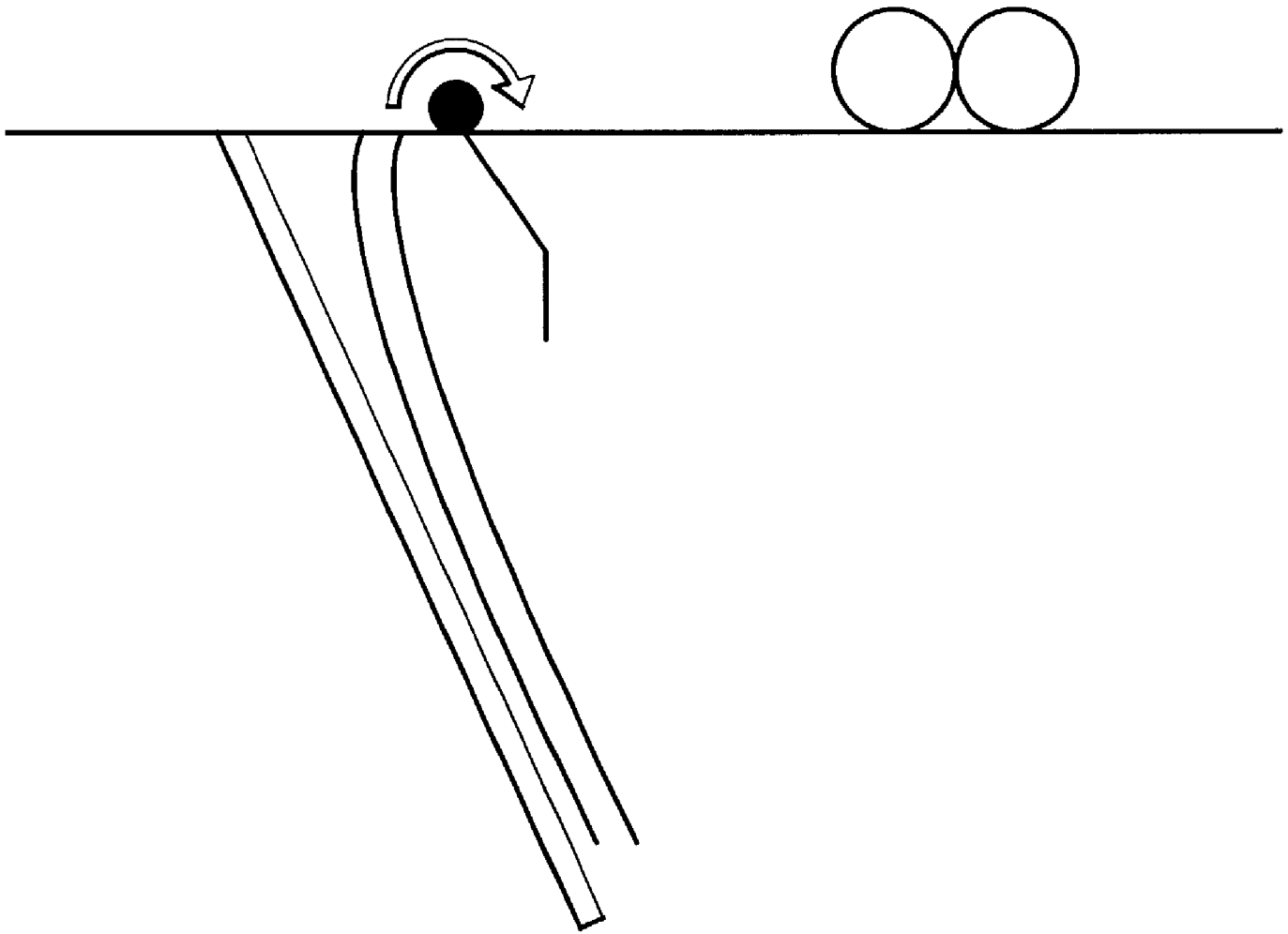
Fig. 6 (Prior Art)
FIG. 6 (prior art) shows the use of retainers at an output bin to prevent positively curled paper from curling within the output tray.
Figure 7:
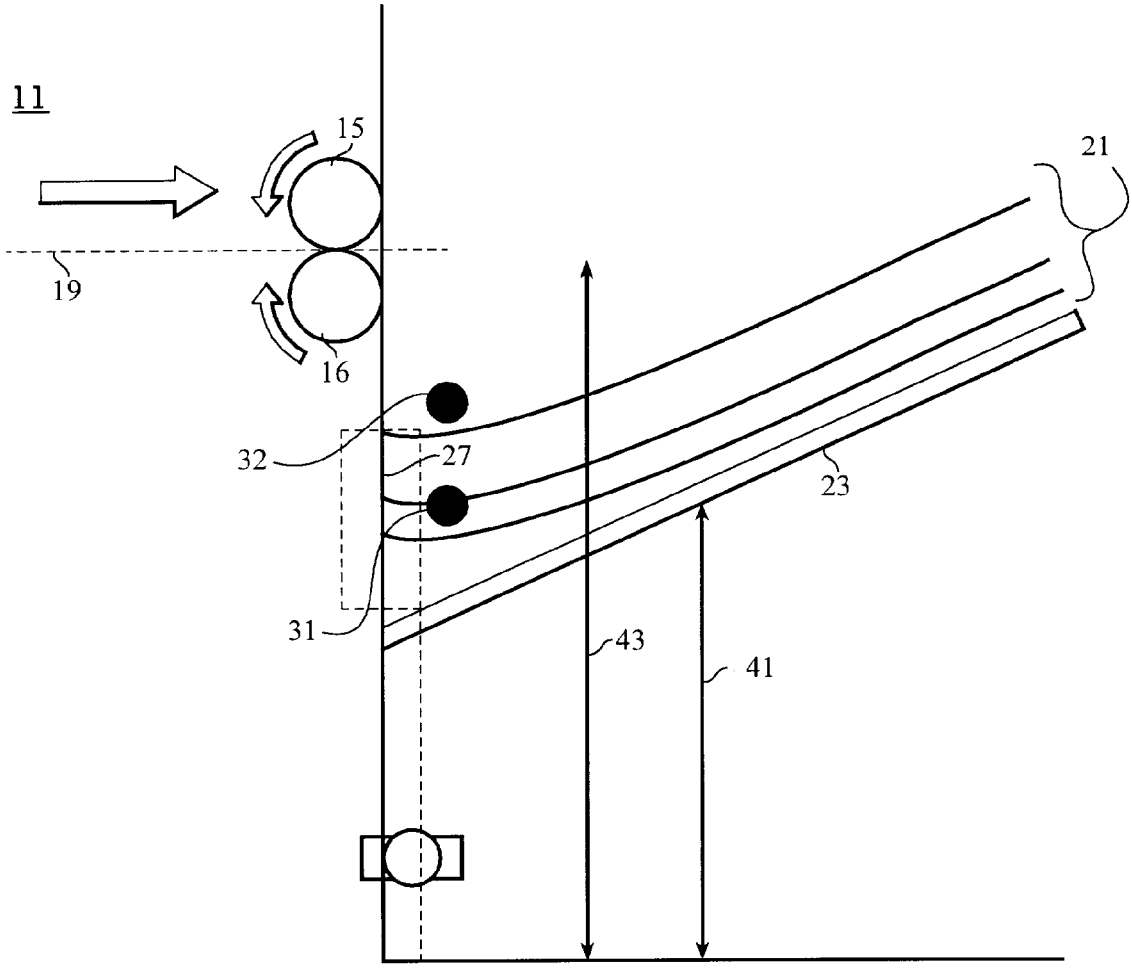
FIG. 7 shows an output tray configured according to the present invention.

FIG. 7 shows a discharge mechanism for a paper handling machine such as a laser printer 11. A pair of discharge rollers, 15, 16 drive a sheet of paper 19 upward from the printer 11. The sheet 19 when discharged will drop onto a stack 21 which rests on a paper tray or output bin 23. The output bin 23 is angled, so that sheets 19 rest in the bin 23 against an end stop 27.

While this invention is primarily focused on use with paper, other types of sheet media may be used. Also, other types of paper handling equipment other than the laser printer 11 represented here may be used.

Figure 8:
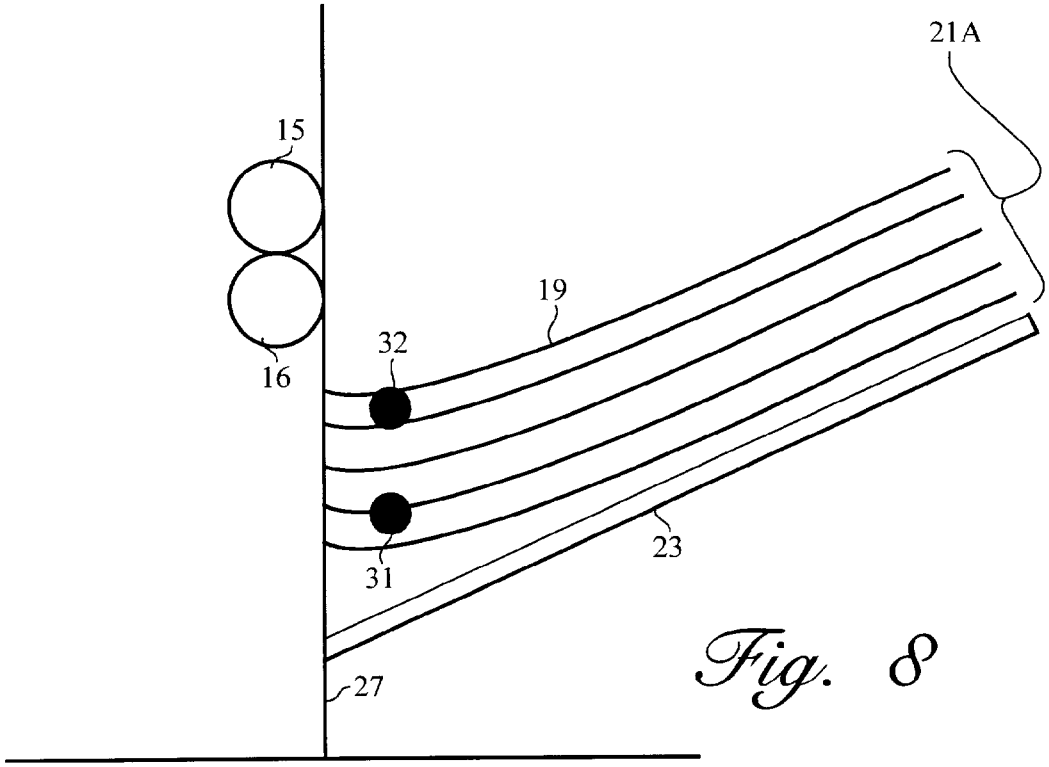
FIG. 8 shows an output tray in which discharged paper is sensed above a "bin full" level as a result of positive curl.

Upon discharge to the stack 21, the sheet 19 becomes part of the stack 21*a*, as shown in FIG. 8. Referring back again to FIG. 7, a pair of sensors 31, 32 are present. Sensor 31 is positioned to detect a presence of paper in the bin 23. This sensor may be fixed to the bin 23 or may be fixed in its vertical position. Sensor 32 detects a "bin full" condition and, in the case of moveable bins, remains at a fixed vertical position. The bin 23 is able to travel vertically. Therefore, the height 41 of the bin 23 is variable, but the height 43 of the discharge rollers' discharge path is fixed. The height 41 is shown at a midpoint along the output bin 23. The position of measurement is unimportant, and it is understood that the height 41 is just a relative term and can be taken at any point along the output bin 23. What is important, is that the bin 23 be able to clear the stack 21 (or 21*a*) from the discharge rollers 15, 16.

As can be seen in FIG. 7, the stack 21 is exhibiting a positive curl adjacent the sensors 31, 32.

Referring to FIG. 8, this positive curl results in the stack 21*a* extending upward in a direction toward the eject rollers 15, 16. This simulates a "bin full" condition, as sensed by sensor 32 because the stack is obstructing IR light which the sensor 32 uses to indicate the bin is full. Based on the paper thickness and the number of pages delivered to bin 23 and the bin full sensor 32, it is possible to determine whether the stack 21 is curled. This can also be used to start the decurling process even before the job is completed. With sheet 19 extending toward sensor 32, the condition is similar to that which would have occurred had the stack 21*a* not curled, but instead had sufficient sheets to fill the bin 23. In this case, the numbering of sheets is less than required to fill the bin 23, but the positive curl results in the stack 21*a* being at a predetermined maximum height. It is possible to reduce this height by reducing the curl in the sheets, thereby resulting in the top sheet 19 being below the height necessary to be sensed by the "bin full" sensor 32.

It is possible to predict the stack height of sheets in the bin 23 based on the number of sheets printed. While the precise thickness of paper is not always known by the printer, the range of permissible sheet media thickness is generally established. If a maximum permissible curl is assumed, that stack height should not exceed a certain value based on the number of sheets and the thickness of the paper or other sheet media being processed. If the stack height of the stack 21 in the bin 23 exceeds that value, then excessive curl is considered to have been detected.

Figure 9:
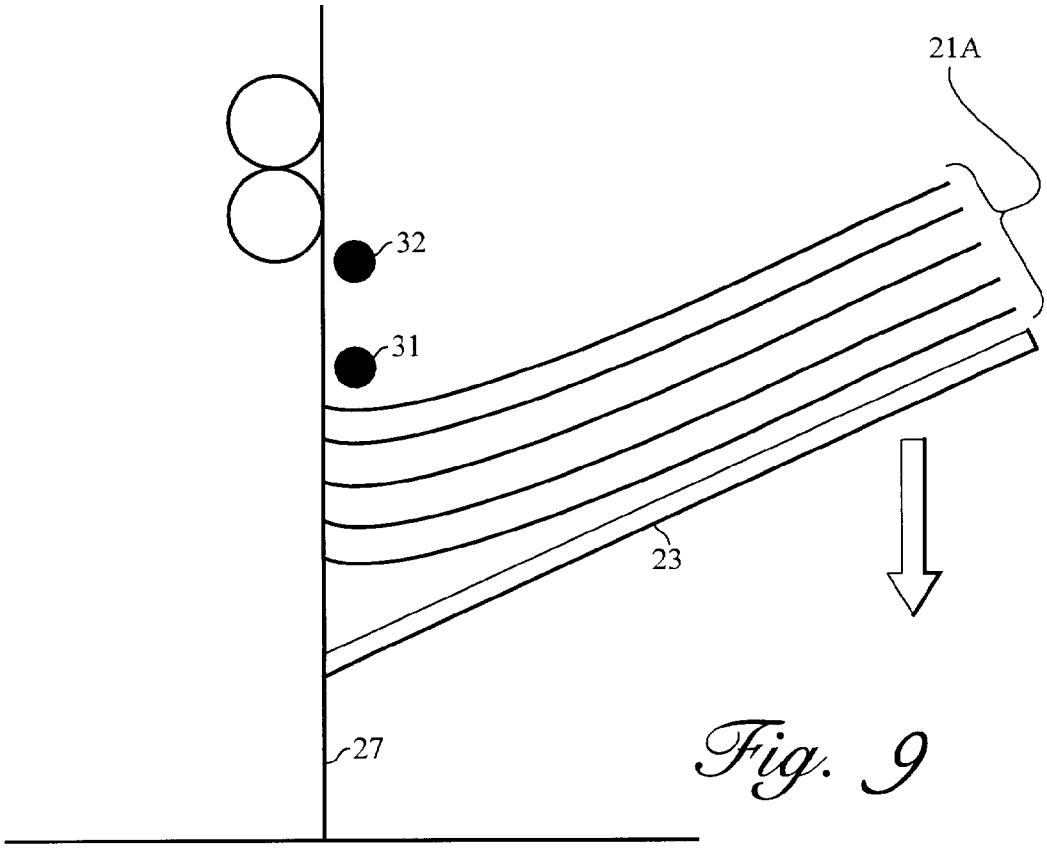
FIG. 9 shows the tray of FIG. 8 after lowering the tray.
Figure 10:
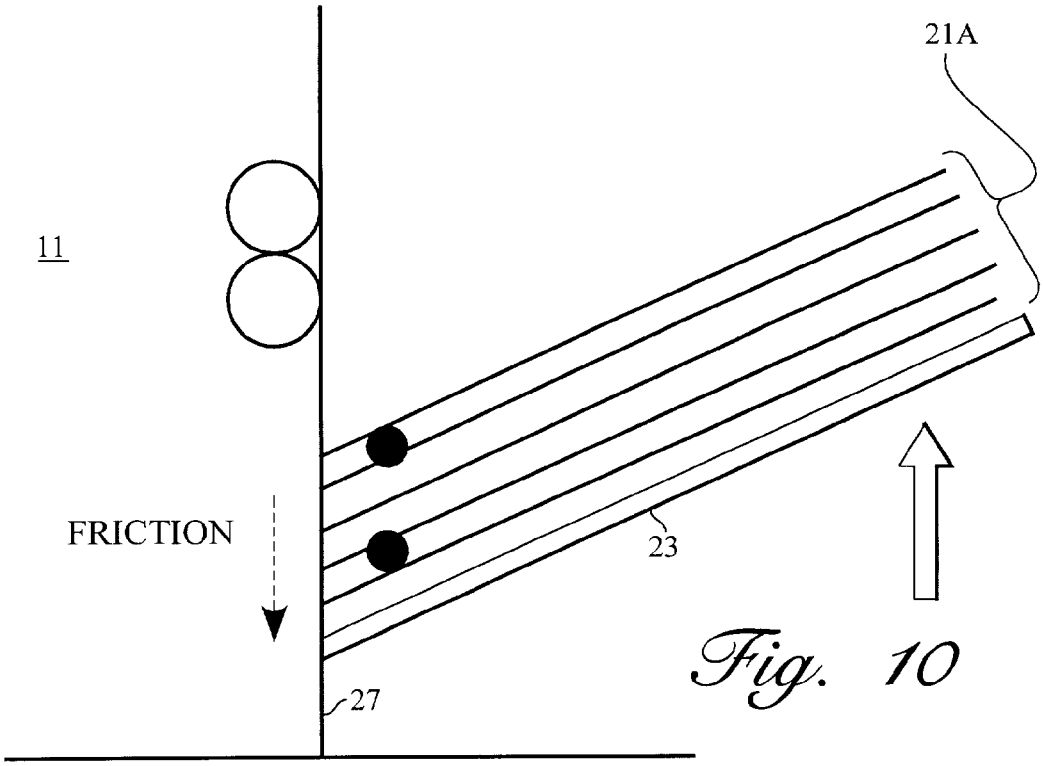
FIG. 10 shows the tray of FIG. 9 after having been raised back to the "bin full" position.
Figure 11:
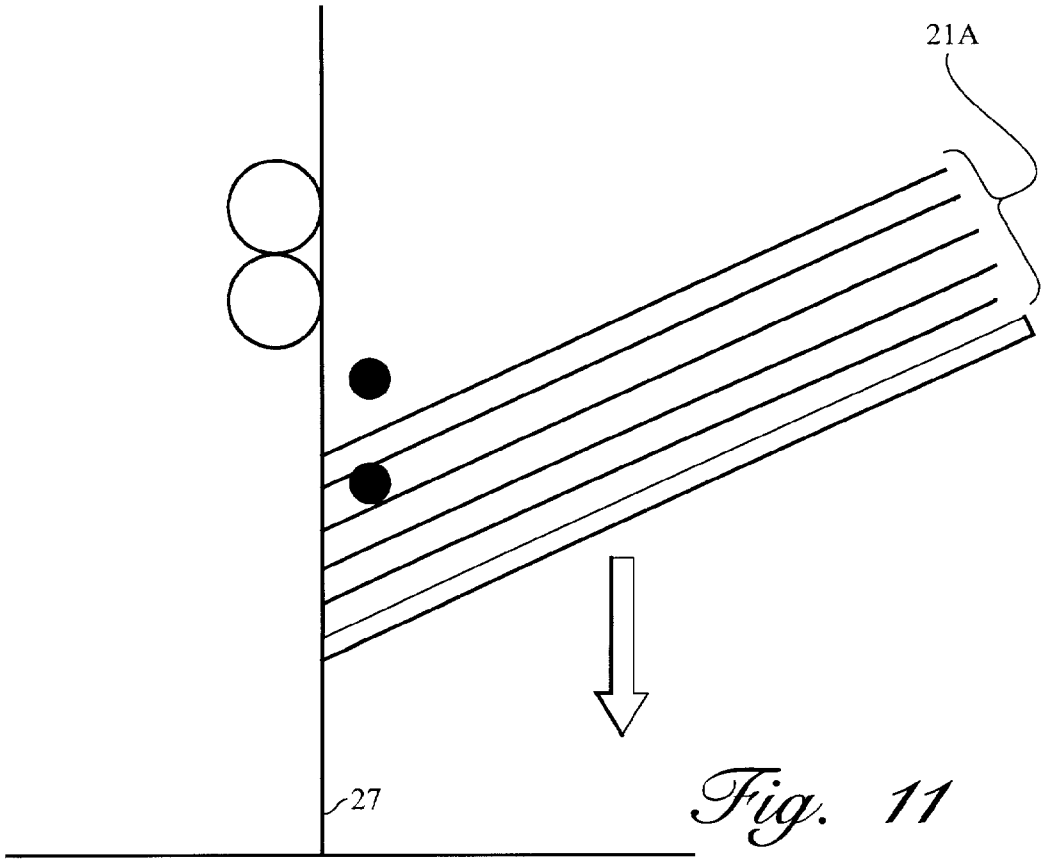
FIG. 11 shows the tray of FIG. 10 having been lowered to a predetermined position below the position of FIG. 10.

In FIG. 9, the bin 23 is lowered. This results in the sheets in the stack 21*a* rubbing against the end stop 27, which for simplicity is depicted as a side wall of the printer 11. In production, it is anticipated that a separate panel would function as the end stop 27. In FIG. 10, the bin 23 is raised, so that friction of the sheets in the stack 21*a* causes the sheets to uncurl. As can be seen in FIGS. 10 and 11, the stack 21*a* is no longer exhibiting a positive curl. The combination of the friction of the end stop and gravity causes the curl to be reduced at that location.

After the stack 21*a* is decurled, it may be weighted down by the top sheets, thereby reducing a tendency to curl.

Figure 12:
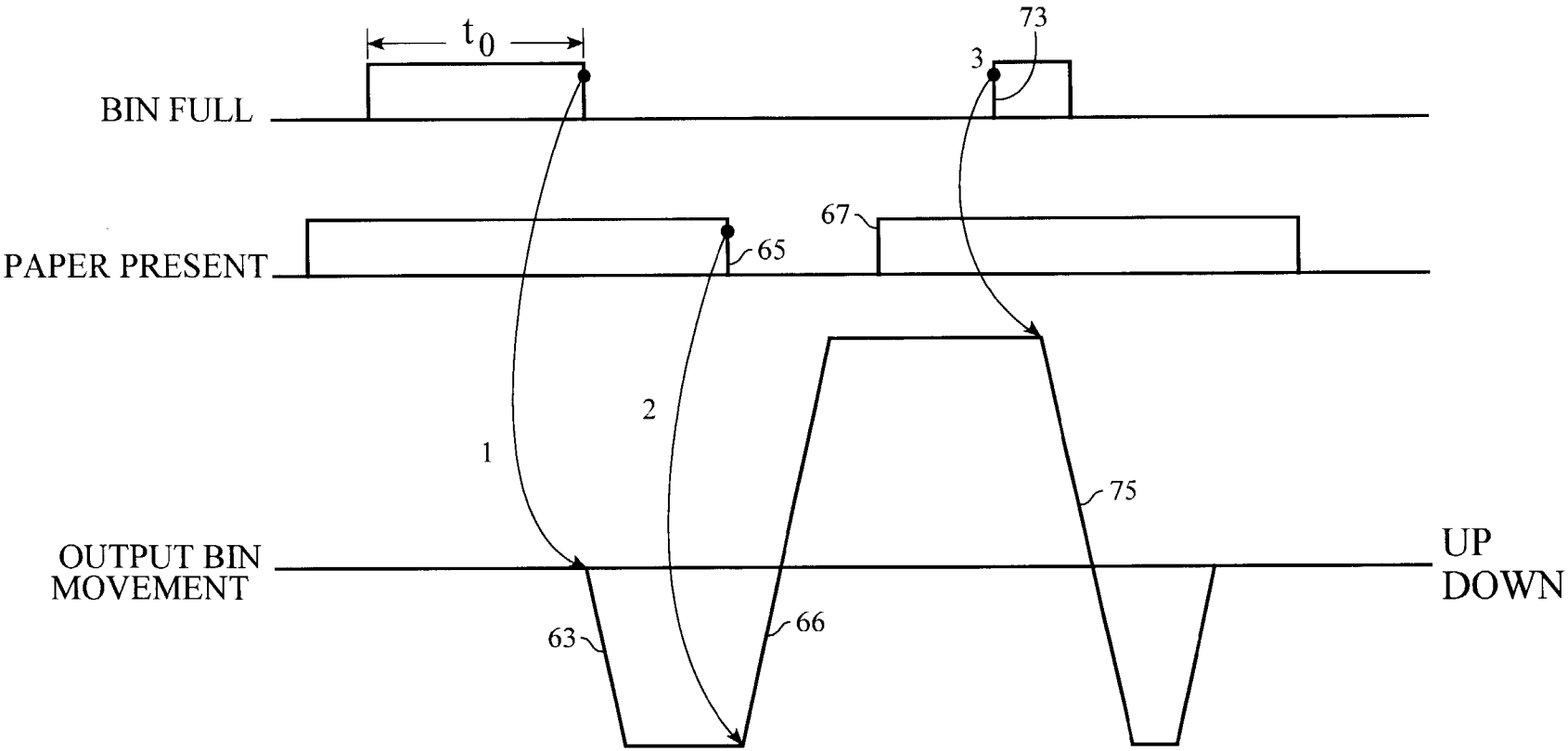
FIG. 12 is a timing diagram showing the sequence of sense paper positions and output bin movements.

Referring to FIG. 12, the sequence is such that the output bin 23 is moved in accordance with the sensing of the stack 21*a* by the sensors 31, 32. Various conditions can be used to start the sequence depicted in FIG. 12. These include the end of a print job, a certain amount of pages delivered to the bin 23, and detecting a curled stack. In this case the output bin 23 is moved vertically in response to the sensed presence of paper at the paper present sensor 31 and at the bin full sensor 32.

As shown on the top line, if, after a predetermined time period $t_0$, the bin full sensor 32 indicates positive, the output bin 23 is moved down, as represented by line 63. This causes the paper to clear the output bin full sensor 32 and continue to clear the paper present sensor 31. When the paper present sensor 31 is clear of paper, as represented by leading edge 65, the bin 23 moves up, as indicated by edge 66. This movement continues until the paper present sensor 31 again reads positive, as indicated at leading edge 67. There are various ways that the cycle terminates, as will be described.

In one embodiment, the cycle terminates some time after the leading edge 67 is detected, but before edge 73. This generally assures that the top of the stack 21 is below a predetermined height.

In this embodiment, the cycle terminates when movement of the bin results in the bin full sensor reading positive, as indicated at leading edge 73. This downward movement may be for a short time period, or by counting a predetermined number of motor pulses. At this time, the output bin moves downward again, as indicated at edge 75. At this point, the top of the stack 21 is at a desired level, so that the height of the top of the stack after different print jobs is uniform.

In this operation, when the output bin is activated for more than $t_0$ seconds, or a predetermined number of sheets are delivered to the stack, the output bin will move downward. Thus, if the top sheet is at the output bin full sensor 32, or a predetermined number of sheets have been discharged, the output bin will move down. This downward movement continues until the paper present sensor 31 is deactivated. At this time, the output bin 23 ceases to move downward and is then caused to move upward.

At this point, the technique to position the output bin 23 at the same height is optional. In one embodiment, once the bin full sensor 32 is again activated, the bin 23 will move down for a small or fixed amount of time so as to always position the output bin 23 so that the stack is at the same height.

Thus, when the output bin full sensor 32 is activated for more than $t_0$ seconds or a predefined number of pages are delivered to the stack 21, the output bin 23 will move down.

Preferably the output bin 23 is cycled at the end of each print job. It is also possible to cycle the output bin 23 after a predetermined number of sheets have been discharged from the printer 11 or when determining that the stack 21 is curled.

The bin is preferably also cycled if the bin full sensor 32 indicates positive for longer than the time for an individual sheet of paper to drop past the sensor 32. This enables the Bin Full condition to start the sequence. The detection of the bin full sensor indicating positive provides an ability to sense that a paper curl problem exists. When this is detected, the printer is halted for sufficient time for the cycling of the output bin 23 to clear the stack 21 from the output path of the printer 11 during the decurling operation. Thus, it is possible to use the bin full sensor 32 to detect if the paper has an unusually high curl.

As can be seen, there are a number of ways to accomplish the paper movements according to the present invention. The above embodiments are given only by way of example. Accordingly, the invention should be read as limited only by the appended claims.

What is claimed is:

1. Method of decurling sheets in a stack of sheet media discharged from a paper handling machine, the method comprising:

a. providing as an output bin, an angled tray, whereby sheets of sheet media discharged from the paper handling machine fall into the tray and travel along the angle of the tray to an end stop positioned at a lower position of the tray, the end stop establishing registration of the sheets;

b. detecting a potential curl condition in the stack;

c. lowering the tray, thereby causing the sheet media in the tray to fall in response to said lowering of the tray; and e. raising the tray subsequent to said sheet media having fallen, thereby causing the sheet media to slide against the end stop.

2. The method of claim 1, wherein said detecting a potential curl condition includes detection of the sheet media at a predetermined height.

3. The method of claim 2, comprising sensing discharge of a predetermined number of sheets from the paper handling machine.

4. The method of claim 2, comprising:

a. interrupting a printing operation of the paper handling machine upon detection for at least a predetermined time period of the presence of the sheet media above the tray at said predetermined height; and b. resuming the printing operation subsequent to said detection.

5. The method of claim 1, comprising:

a. detecting a presence of the sheet media provided at a first predetermined height;

b. sensing presence of the sheet media at a second predetermined height; and c. discontinuing upward movement of the tray during said raising the tray in response to said detection of the sheet media at the second predetermined height.

6. The method of claim 5, comprising:

a. using a first optoelectric sensor for said detecting the presence of the sheet media above the tray at said first predetermined height;

b. using a second optoelectric sensor for said sensing presence of the sheet media at said second predetermined height; and c. said first and second optoelectric sensors fixed in a vertical position such that tray exhibits relative movement with the sensors, thereby permitting sensing of sheet media stack height with the sensors.

7. The method of claim 5, comprising:

lowering and raising the tray at the completion of a print job.

8. The method of claim 5, comprising:

a. lowering and raising the tray upon detection for at least a predetermined time period of the presence of the sheet media above the tray at said first predetermined height; and b. lowering and raising the tray upon discharge of a predetermined number of sheets.

9. The method of claim 1, comprising detecting when the sheet media in the tray has fallen in response to said lowering of the tray.

10. The method of claim 1, comprising:

lowering and raising the tray upon discharge of a predetermined number of sheets.

11. The method of claim 1, comprising:

lowering and raising the tray at the completion of a print job.

12. Method of detecting sheet curl in a stack of sheet media discharged from a paper handling machine, the method comprising:

a. providing an output bin, whereby sheets of sheet media discharged from the paper handling machine fall into the tray, the tray establishing registration of the sheets;

b. establishing an anticipated value for detection of sheet media having a curl;

c. detecting a presence of the sheet media above the tray at said predetermined height; and d. comparing said detection with said anticipated value for detection of the sheet media having a curl at a predetermined value.

13. The method of claim 12, comprising:

a. said detection of the presence of the sheet media established by an optoelectric sensor; and b. the output bin positioned so that a predetermined number of sheets of a given type having a curl in excess of said predetermined value cause said detection.

14. The method of claim 12, comprising:

a. interrupting a printing operation of the paper handling machine upon detection for at least a predetermined time period of the presence of the sheet media above the tray at said predetermined height; and b. resuming the printing operation subsequent to said detection.

15. Apparatus for stacking sheet media, comprising:

a. a discharge apparatus;

b. an angled tray positioned to receive sheets of said sheet media discharged from the discharge apparatus, and having an angle such that said sheet media travels along the angle of the tray;

c. an end stop, positioned against the tray, the end stop at a lower position of the tray and establishing registration of the sheets at the end stop;

d. a sensor for detecting a presence of the sheet media above the tray at a predetermined height;

e. a mechanism to vertically position the tray with respect to the end stop; and f. a controller which, upon detection of the sheet media at the predetermined height causes the mechanism to vertically position the tray to move the tray downward, and upon detection that the sheet media in the tray has fallen in response to said lowering of tray causes the mechanism to vertically position the tray to move upward, said upward movement urging the sheet media downward against the tray as a result of friction between the sheet media and the end stop.

16. Apparatus as described in claim 15, comprising:

a. a sensor for detecting a presence of the sheet media above the tray at a second predetermined height; and b. the controller discontinuing downward movement of the tray in response to said detection of the sheet media below a second predetermined height, with the second predetermined height at a lower level than the first predetermined height.

17. Apparatus as described in claim 16, wherein:

the controller discontinues upward movement of the tray in response to said detection of the sheet media at the second predetermined height.

* * * * *